United States Patent [19]

Izuta

[11] Patent Number: 4,702,067

[45] Date of Patent: Oct. 27, 1987

[54] ARCHERY STRING

[75] Inventor: Tadao Izuta, Shizuoka, Japan

[73] Assignee: Nippon Gakki Seizo Kabushiki Kaisha, Japan

[21] Appl. No.: 839,416

[22] Filed: Mar. 14, 1986

[30] Foreign Application Priority Data

Apr. 23, 1985 [JP] Japan ..... 60-060924[U]
Apr. 23, 1985 [JP] Japan ..... 60-060925[U]

[51] Int. Cl.[4] ..... D02G 3/00

[52] U.S. Cl. ..... 57/243; 124/90; 273/DIG. 4; 428/364

[58] Field of Search ..... 57/200, 201, 210, 211, 57/225, 231, 236, 237, 243; 124/90; 273/DIG. 4; 43/44.98; 428/364; 526/352; 264/184

[56] References Cited

U.S. PATENT DOCUMENTS

| | | | |
|---|---|---|---|
| 3,018,610 | 1/1962 | Kleinekathofer | 57/248 X |
| 3,216,187 | 11/1965 | Chantry et al. | 57/243 X |
| 3,413,797 | 12/1968 | Chapman | 57/243 |
| 3,838,561 | 10/1974 | Munting | 57/243 |
| 3,968,725 | 7/1976 | Holzhauer | 57/210 X |
| 4,168,606 | 9/1979 | Callander | 57/236 X |
| 4,339,499 | 7/1982 | Tappe et al. | 57/243 X |
| 4,413,110 | 11/1983 | Kavesh et al. | 526/352 X |
| 4,551,296 | 11/1985 | Kavesh et al. | 264/184 X |

*Primary Examiner*—Donald Watkins
*Attorney, Agent, or Firm*—Lerner, David, Littenberg, Krumholz & Mentlik

[57] ABSTRACT

An archery string is produced of polyethylene monofilaments of a super high molecular weight by multi-staged bundling and twisting in order to lower the elongation percentage, thereby assuring high hitting rate in shooting and better endurance.

9 Claims, 2 Drawing Figures

ARCHERY STRING

BACKGROUND OF THE INVENTION

The present invention relates to an improved archery string, and more particularly relates to improvement in mechanical properties at stretch of an archery string including strands made up of a lot of synthetic monofilament yarns.

Most conventional archery strings of the above-described type are made of polyester monofilaments which in general have too high elongation percentage, i.e. the magnitude of elongation of a string under application of a fixed load. Such high elongation percentage impairs repulsion of the string and lowers the initial velocity of arrows at release, thereby lowering hitting rate in shooting.

It is thinkable to lower the twist of each strand in order to lower its elongation percentage. Such an expedient, however, reduces the maximum number of use at breakage and impairs endurance of the string. For these reasons, it is not advisable to adjust the elongation percentage of a string by reducing the twist of the strands.

SUMMARY OF THE INVENTION

It is the object of the present invention to lower the elongation percentage of an archery string without any ill influence on its endurance.

In accordance with the present invention, an archery string includes a plurality of strands bundled together, each strand is made up of a plurality of elementary yarns of a prescribed thickness twisted together, and each elementary yarn is made up of a plurality of polyethylene monofilaments bundled together.

DESCRIPTION OF THE PREFERRED EMBODIMENTS

Figure 1:
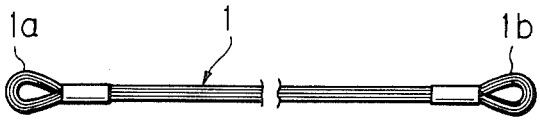
FIG. 1 is a plan view of one embodiment of the archery string in accordance with the present invention.

One example of the archery string in accordance with the present invention is shown in FIG. 1, in which an archery string 1 is provided with a pair of end loops 1*a* and 1*b* for attachment to an archery bow.

As the starting material, monofilaments are made of polyethylene of a super high molecular weight. That is, the thickness of the monofilament should preferably be in a range from 5 to 20 deniers, Youngs modulus at stretch should preferably be in a range from 80 to 150 GPa (International Systems SI units) and the specific gravity should preferably be in a range from 0.96 to 0.98. A plurality of such monofilaments are bundled together substantially with no twists to form an elementary yarn of 500 to 1500 deniers thickness. In the case of the illustrated example, three elementary yarns are twisted together without any twists on each yarn to form a strand. The thickness of each elementary yarn and the number of elementary yarns to be twisted together so that the thickness of a resultant strand should preferably be in a range from 18,000 to 28,000 deniers. Such strands are bundled together to form an archery string such as shown in FIG. 1.

When three elementary yarns are twisted together to form a strand, the pitch of twists on the strand is given by 10000×(60–120)/thickness of the elementary yarns. Either S and Z twists are employable. Some examples of the pitch of twists are given in Table 1.

TABLE 1

| Thickness of the elementary yarn in denier | Number of twists per meter on the strand |
|---|---|
| 500 | 120~240 |
| 1000 | 60~120 |
| 1500 | 40~80 |

Figure 2:
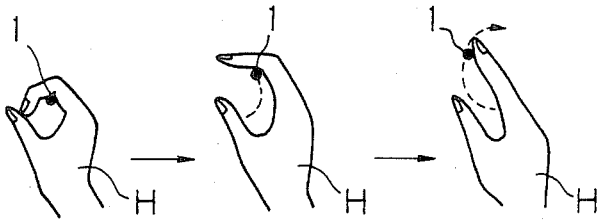
FIG. 2 is a plan view of the relation between the archery string and the archer's hand at release of an arrow.

According to the present invention, the elongation percentage of the archery string is adjusted to the range from 0.08 to 1.2% and, as a consequence, the repulsion of the string at release is greatly enlarged, the string returns forward very quickly and initial velocity of an arrow at release is raised considerably, thereby much improving the hitting rate in shooting. In particular a skilled archer opens fingers very swiftly at release. More specifically as best seen in FIG. 2, shift in hand position from the left to right state is very swift in the case of a skilled archer and, as a consequence, slow forward return of the string would allow itself to move as indicated with a dot line and this curved return of the strings would cause end whip of an arrow. For these reasons, strings with low elongation percentage are in general favoured by skilled archers.

In another example of the present invention, a plurality of monofilaments are bundled together substantially with no twists to form an elementary yarn of 500 to 1500 denier thickness. After application of individual twists, two elementary yarns are twisted together to form a strand. A plurality of such strands are bundled together to form an archery string in accordance with the present invention.

At application of individual twists on the elementary yarn, the pitch of twists on the elementary yarn is given by 1000 (200–350)/ thickness of the elementary yarns. Whereas the pitch of twists on the strand is given by 1000×(200–350)/ thickness of the elementary yarns. S twists may be used for the individual twists on the elementary yarn in combination with Z twists used for the general twists on the strand. The combination may be reversed. Some samples of the pitch of twists are given in Table 2.

TABLE 2

| Thickness of the elementary yarn in denier | Number of twists per meter on the strand | Number of twists per meter on the elementary yarn |
|---|---|---|
| 500 | 400~700 | 400~700 |
| 1000 | 200~350 | 200~350 |
| 1500 | 133~233 | 133~233 |

According to the present invention, subdued elongation percentage assures improved mechanical properties of an archery string with rich endurance.

I claim:

1. An improved archery string comprising a plurality of strands bundled together, each said strand being made up of a plurality of elementary yarns of a prescribed thickness twisted together, each said elementary yarn being made up of plurality of polyethylene monofilaments bundled together, each said monofilament having a thickness in a range of 5 to 20 denier, a Young's modulus in a range from 1.16×10 to 2.18×10 pounds per square inch, and a specific gravity in a range from 0.96 to 0.98.

2. An improved archery string as claimed in claim 1 in which the thickness of said elementary yarn is in a range from 500 to 1500 deniers.

3. An improved archery string as claimed in claim 1 in which said strand includes three elementary yarns with no individual twists.

4. An improved archery string as claimed in claim 1 in which said strand includes two elementary yarns with individual twists.

5. An improved archery string as claimed in claim 4 in which the pitch of individual twists on said elementary yarn is given by 1000×(200–350)/the thickness of the elementary yarns.

6. An improved archery string as claimed in claim 3 or 4 in which the pitch of general twists on said strand is given by 1000×(60–120)/the thickness of the elementary yarns.

7. An improved archery string as claimed in claim 1 in which the thickness and number of said strands to be bundled is chosen so that the resultant final thickness should be in a range from 18000 to 28000 deniers.

8. The archery string of claim 1 wherein said string has a string elongation percentage in a range of 0.8 to 1.2.

9. An improved archery string comprising a plurality of strands bundled together, each said strand being made up of a plurality of elementary yarns of a prescribed thickness twisted together, each said elementary yarn being made up of a plurality of polyethylene monofilaments bundled together so that said archery string has a string elongation percentage in a range of 0.8 to 1.2.

* * * * *

UNITED STATES PATENT AND TRADEMARK OFFICE

CERTIFICATE OF CORRECTION

PATENT NO. : 4,702,067

DATED : October 27 1987

INVENTOR(S) : T. Izuta

It is certified that error appears in the above-identified patent and that said Letters Patent is hereby corrected as shown below:

Column 2, line 3, change "10000 to --1000--;

line 17 chage "0.08" to --0.8--.

Signed and Sealed this

Fifth Day of April, 1988

*Attest:*

DONALD J. QUIGG

*Attesting Officer*

*Commissioner of Patents and Trademarks*